US005142991A

United States Patent [19]

Theis

[11] Patent Number: 5,142,991

[45] Date of Patent: Sep. 1, 1992

[54] INCLINED RAIL TROLLEY SAFETY DEVICE WITH LEVER OPERATED CABLE SHIEVE FOR TAKING UP SLACK IN THE CABLE TO CONTROL TROLLEY DRIVE

[75] Inventor: David L. Theis, Prior Lake, Minn.

[73] Assignee: Access Mobility Systems, Inc., Shakopee, Minn.

[21] Appl. No.: 715,461

[22] Filed: Jun. 14, 1991

[51] Int. Cl.[5] ..... B61B 9/00; B61B 12/04

[52] U.S. Cl. ..... 104/178; 104/183; 187/12

[58] Field of Search ..... 104/117, 139, 140, 173.1, 104/178, 183, 196; 187/12, 13, 45

[56] References Cited

U.S. PATENT DOCUMENTS

| | | | |
|---|---|---|---|
| 151,014 | 5/1874 | Fensom | 187/89 |
| 253,695 | 2/1882 | Hafner | 187/89 |
| 387,019 | 7/1888 | Tait | 187/13 X |
| 482,495 | 9/1892 | Bassett | 187/45 |
| 527,069 | 10/1894 | Neil | 104/178 |
| 989,135 | 4/1911 | Dyer | 187/13 X |
| 1,438,426 | 12/1922 | Cline | 187/13 |
| 1,746,163 | 2/1930 | Perkins | 188/127 |
| 1,878,734 | 9/1932 | Ulrich | 188/127 |
| 2,344,829 | 3/1944 | Mc Avoy | 104/178 X |
| 2,617,499 | 11/1952 | Jenkins et al. | 104/183 X |
| 2,886,136 | 5/1959 | Stelzer | 187/13 |
| 3,495,547 | 2/1970 | Bishop | 104/178 X |
| 3,565,216 | 2/1971 | Gohlke | 104/178 X |
| 3,805,923 | 4/1974 | Baker | 188/38 |
| 4,089,391 | 5/1978 | Schill | 187/89 X |
| 4,179,012 | 12/1979 | Heberle | 187/12 |

*Primary Examiner*—Robert J. Oberleitner
*Assistant Examiner*—S. Joseph Morano
*Attorney, Agent, or Firm*—Palmatier & Sjoquist; Palmatier & Sjoquist

[57] ABSTRACT

A safety device for a trolley riding an inclined track. The safety device includes a safety line running parallel to a tow cable operating the trolley. The trolley includes a lever with a distal end continuously engaging the safety line. When the lever is swung, the distal end takes up slack in the safety line and trips a switch at an end of the safety line to stop operation of the tow cable. The safety device further includes a tension mechanism for maintaining a predetermined amount of tension in the line and for automatically returning the line to such tension after the lever has been pulled. The safety device further includes an isolator connected between the safety line and the switch to isolate the switch from vibrations or disturbances in the line during operation of the trolley to minimize a premature tripping of the switch. The safety device still further includes a cowcatcher or lever portion extending transversely of the track for swinging the lever and taking up slack in the line when the cowcatcher engages an obstruction on the track.

12 Claims, 3 Drawing Sheets

INCLINED RAIL TROLLEY SAFETY DEVICE WITH LEVER OPERATED CABLE SHIEVE FOR TAKING UP SLACK IN THE CABLE TO CONTROL TROLLEY DRIVE

BACKGROUND OF THE INVENTION

The present invention relates to safety mechanisms for trolleys and, more particularly, to such safety mechanisms incorporating a safety line extending the length of the trolley track.

Lakefront property often includes steep inclines between the lake and lodging facilities. These inclines may include jagged, slippery rocks as well as bushes and trees. Accordingly, the inclines are difficult if not impossible for the elderly to climb and are cumbersome if not dangerous for others to negotiate, especially with fishing poles and tackle boxes in hand.

Construction of stairs traversing these inclines is typically expensive. Even if constructed, a staircase may be too steep or too long for elderly people.

As an alternative to a staircase, a lift may operate on a track mounted on an incline. A standard lift may have complicated, elaborate, and expensive safety or braking mechanisms to stop a runaway lift. Some of these braking mechanisms are activated upon the sensing of a predetermined speed and may include drop bars to engage the track to stop the cart.

SUMMARY OF THE INVENTION

An object of the present invention is to provide a trolley safety device that is operational from the trolley itself.

Another object of the present invention is to provide a trolley safety device that operates the means driving the tow cable of the trolley.

Another object of the present invention is to provide a safety device that incorporates a mechanical connection between the trolley and the drive operating the tow cable.

Another object of the invention is to provide a manually-operated safety device to complement automatically-activated safety devices.

A feature of the present invention is the provision in a trolley operation having a trolley riding an inclined track and operated by a tow cable, of a safety line being independent of the tow cable and extending the length of the track and engaging the drive means of the tow cable.

Another feature is the provision in such a trolley operation of engagement means for taking up slack in the safety line to operate the drive means of the tow cable.

Another feature is the provision in such a trolley operation of tension means for maintaining a predetermined amount of tension in the safety line to minimize the requisite amount of slack taken out of the line to operate the switch.

Another feature is the provision in such a trolley operation of the tension means including bias means for automatically returning the line to the predetermined amount of tension after the lever has been operated.

Another feature is the provision in such a trolley operation of isolation means connected between the safety line and the switch of the operating means for isolating the switch from vibrations or disturbances in the line to minimize premature tripping of the switch.

Another feature is the provision in such a trolley operation of the engagement means including a lever which extends into the passenger section of the trolley to be pulled to take up slack in the line.

Another feature is the provision in such a trolley operation of the lever including a second portion which is disposed adjacent to and transversely of the track to be engaged by an obstruction on the track.

An advantage of the present invention is that a trolley may be operated safely on a steep incline.

Another advantage is that a trolley is manually operable and controllable from the trolley itself.

Another advantage is that the trolley may be stopped upon engagement of a track obstruction not visible to trolley passengers.

Another advantage is that the trolley may be controlled from any portion along the track.

Another advantage is that the safety device is simple to install, maintain, and operate.

Another advantage is that the safety device is reliable.

Another advantage is that the safety device may complement other trolley safety mechanisms and may be easily incorporated as an add-on feature.

DETAILED DESCRIPTION OF THE PREFERRED EMBODIMENTS

Figures 1, 3, 3A:
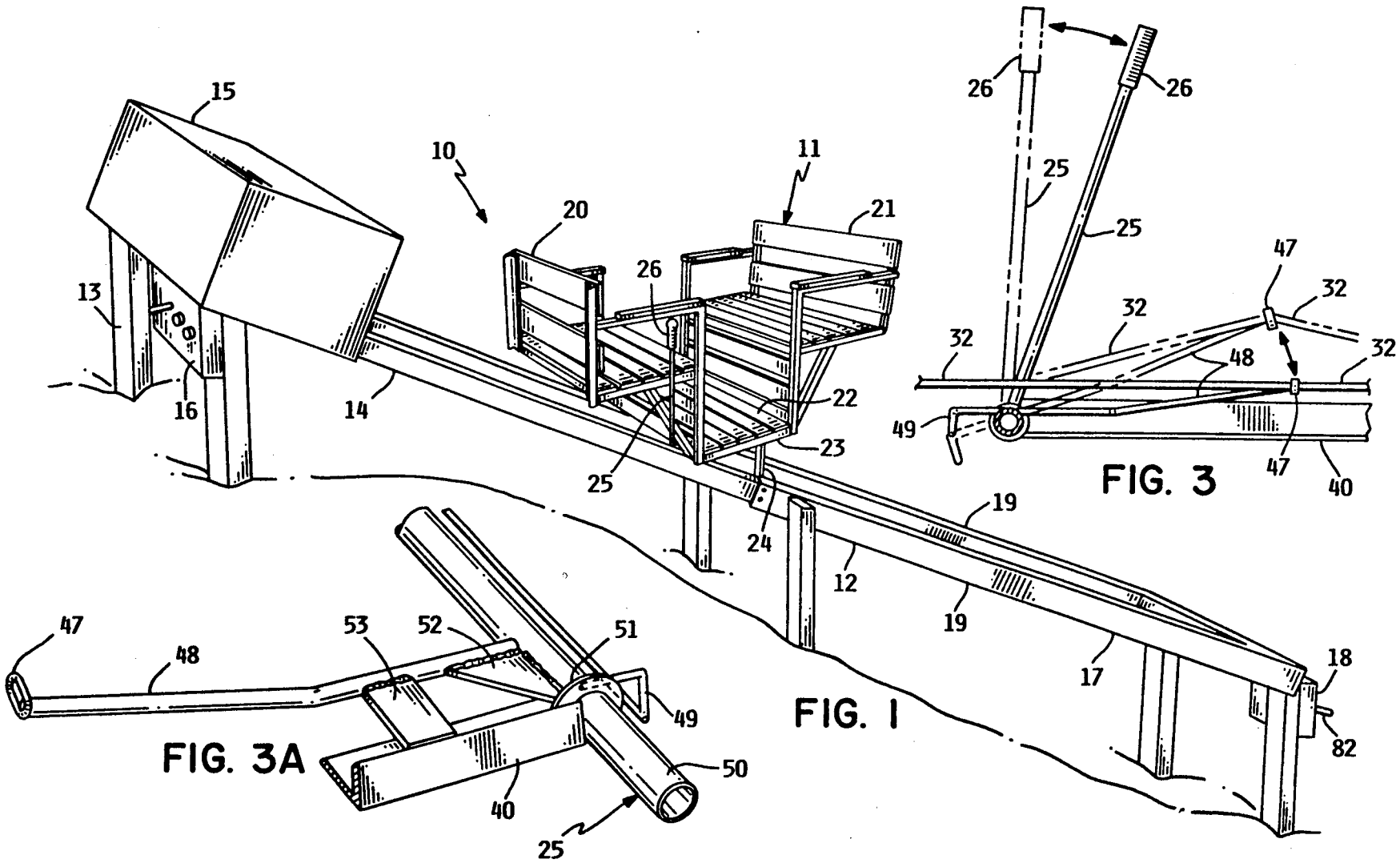
FIG. 1 Is a perspective, diagrammatic view of a trolley operation incorporating the present safety device.
FIG. 3 is a detail, partial view of the lever of the safety device of FIG. 1 for taking up slack in the safety line.
FIG. 3A is a detail, partial view of the lever of the safety device of FIG. 1.

As shown in FIG. 1, the present trolley operation is indicated in general by the reference numeral 10 and includes a trolley 11 riding on a track 12 which is supported relative to the ground or steep incline by four or more support legs 13. The track 12 includes an upper portion 14 having an operating or control means 15 with a control box 16, and a lower portion 17 having a control box 18. The track 12 includes a pair of spaced-apart, U-channel rails 19.

As seen in FIG. 1, the trolley 11 includes a passenger section formed by opposing seats 20, 21 and a floor 22. The floor 22 of the trolley 11 is supported by a frame 23 which includes upright, downwardly extending bars 24. A lever 25 extends upwardly into the passenger section from beneath the floor 22. Lever 25 includes a handle 26.

Figure 2:
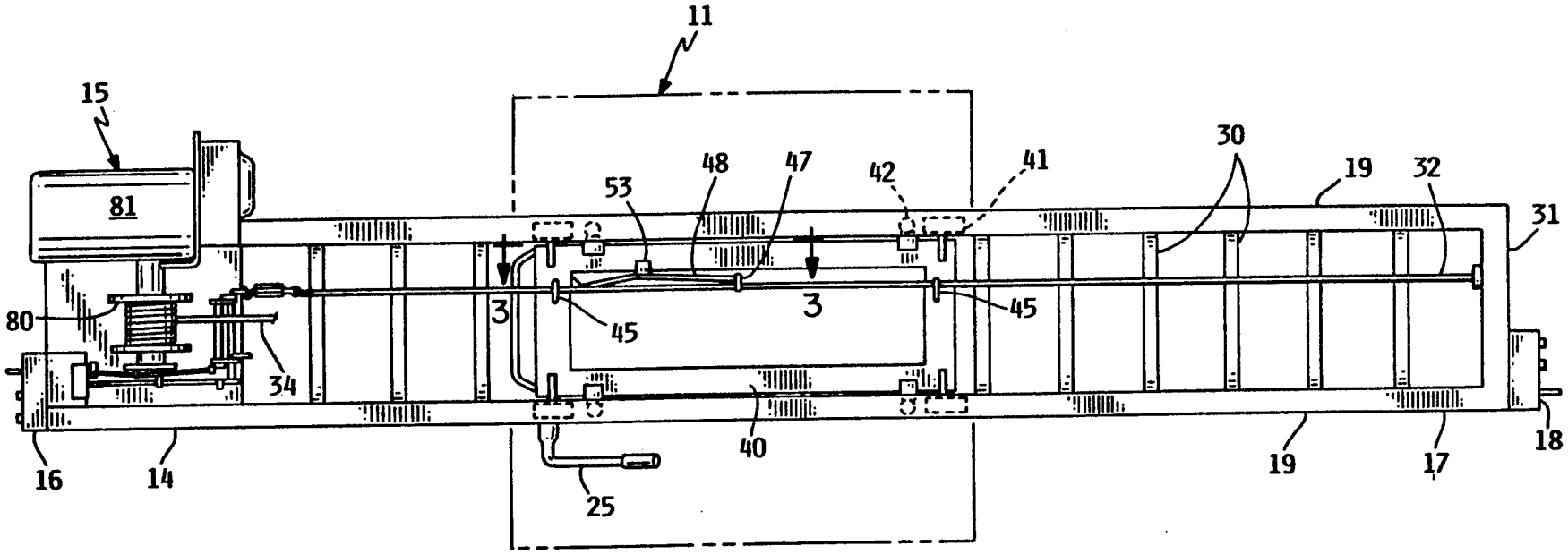
FIG. 2 is a top plan view of the trolley operation of FIG. 1 with portions of the trolley in phantom.

As shown in FIG. 2, the rails 19 of the track 12 are spaced apart by a plurality of transversely extending crossties 30. The lower control box 18 is mounted on a lowermost crosstie 31. The safety or control line 32 extends between the lowermost crosstie 31 and the operating means 15. A to cable 34 for towing the trolley 11 is operatively connected between the operating means 15 and the trolley 11.

As also shown in FIG. 2, the trolley 11 includes a main rectangular frame 40 on which bars 24 and frame 23 of the passenger section are mounted and to which tow cable 34 is connected. The frame 40 mounts a set of four wheels 41 for riding in the U-channel rails 19 and for receiving the weight of the trolley 11. A set of four casters or rollers 42 also ride in the U-channel rails 19 for limiting side-to-side movement of the trolley 11 and for preventing the outer faces of the wheels 41 from rubbing the outer portions of the U-channel rails 19.

The frame 40 further includes a pair of aligned eyelets 45 for engaging the safety line 32. The safety line 3 is further engaged by an eyelet 47 mounted on a distal portion 48 of the lever 25. The distal portion 48 is raised to take up slack in the safety line 32 when the lever 25 is pulled. Distal portion 48 is also raised to take up slack in the line 32 when a bumper 49 mounted on the lever 25 is pivoted downwardly such as by an obstruction of the track 12.

The lever 25 is shown in more detail in FIG. 3A. The lever 25 includes a fulcrum portion 50 which is engaged by a pair of bearings 51, each of which is rigidly mounted on opposing portions of the frame 40. The lever distal end 48 is rigidly connected to the fulcrum portion 50 by a gusset 52. A plate-like stop 53 is welded to the distal portion 48. The stop 53 normally rests on the frame 40 to dispose the eyelet 47 at the proper elevation to allow continuous travel therethrough of the safety line 30. The stop 53 also prevents the distal portion 48 from failing to engage the crossties 30. The bumper 49 may be referred to as a cowcatcher. The bumper 49 is rigidly connected to the fulcrum portion 50 and extends transversely of the track 12 to engage obstructions to the path of travel of the trolley 11. When the bumper 49 is pivoted downwardly, the distal end portion 48 and eyelet 47 are raised to take up slack in the safety line 32.

Figure 4:
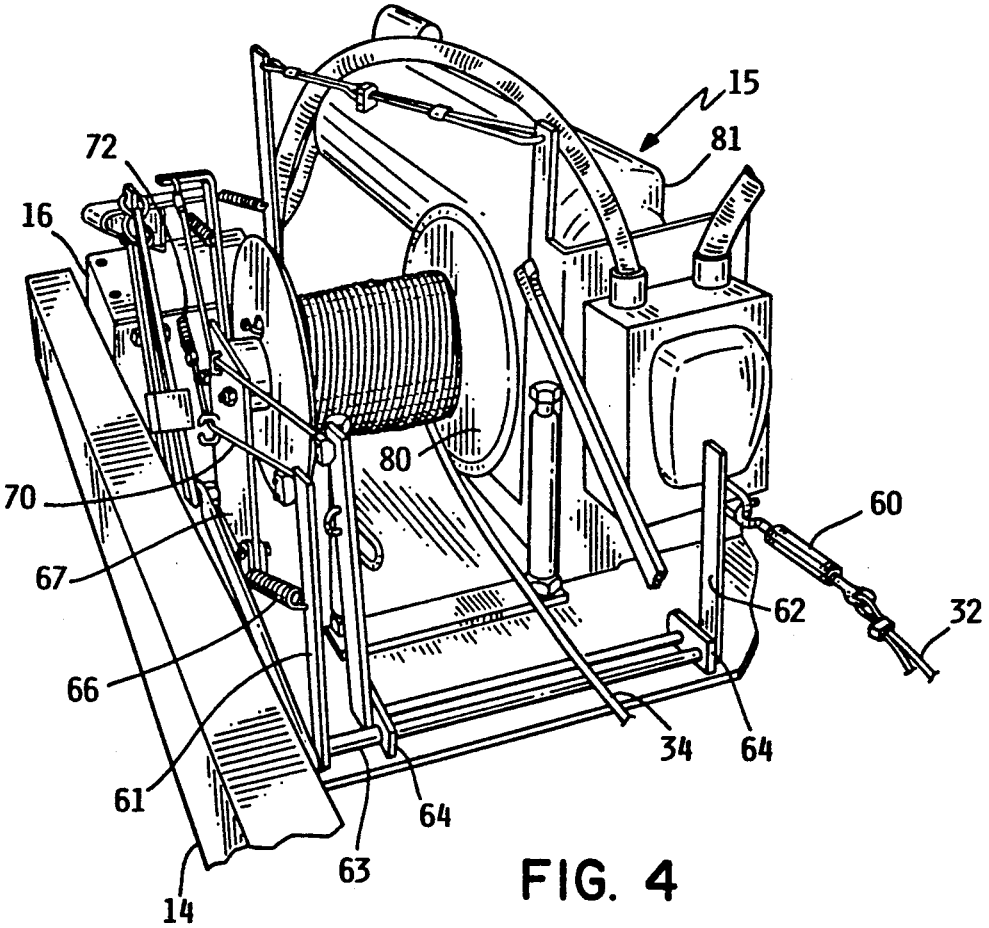
FIG. 4 is a perspective view of portions of the safety device and drive means of the trolley operation of FIG. 1.
Figure 5:
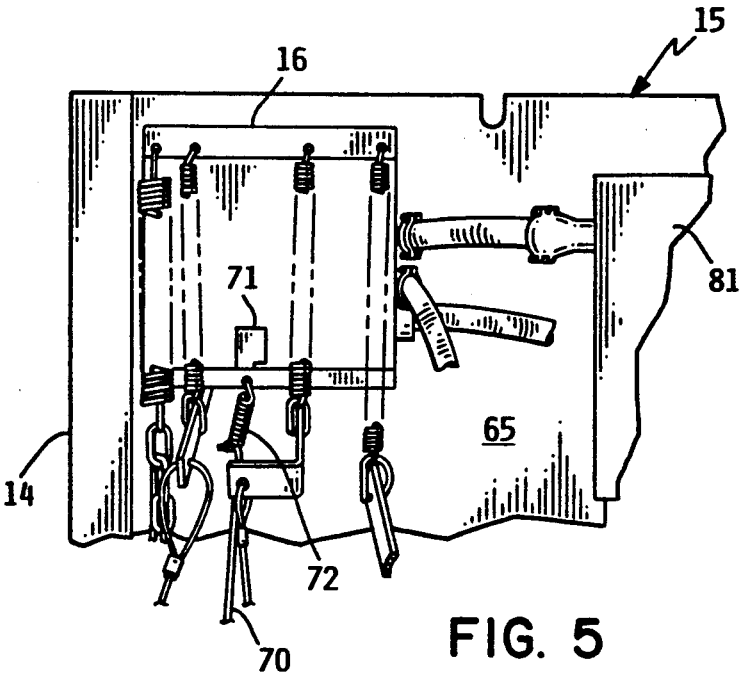
FIG. 5 is a top plan view of the safety device and drive means of FIG. 4.

As shown in FIG. 4, the safety line 32 includes a threaded connector 60 adjacent the operating means 15 for increasing or decreasing the length of or the tension in the line 32. Adjacent to the threaded means 60, the line 32 is affixed to respective tension means or pivot bar 62, which is rigidly connected to a spring biased pivot bar 61 via a rod 63, which engages bearing 64. The bearing 64 may be rigidly affixed to plate 65 or other structural frame members of the operating means 15. Plate 65 is affixed between rails 19. Bars 61, 62 are spring biased through a coil spring 66 affixed between bar 61 and a structural plate 67 of the operating means 15. The spring 66 takes up slack in the line 32, and maintains a predetermined amount of tension in the safety line 32 to minimize the amount of slack required to be taken out of the line 32 by the lever 25. After the lever 25 has been disengaged, the coil spring 66 retracts the bar 62 to return the predetermined amount of tension to the line 32. As shown in FIGS. 4 and 5, bar 61 includes a cord 70 connected to a switch 71 of the operating means 15 via an isolation means or coil spring 72. The coil spring 72 isolates the switch 71 from disturbances or vibrations in the line 32. Switch 71 is operated when the bar 61 is pivoted by the line 32 and the cord 70 is pulled sufficiently to extend and pull the coil spring 72 to trip the switch 71. Switch 71 is a four-way switch cycling through off, forward, off, and reverse modes endlessly.

It should be noted that operating means 15 includes a cable drum 80 for taking up the tow cable 34, and a one and one-half horsepower open 220V motor 81 with a 110V electric brake and a sixty to one worm 90. reducer. It should be noted that the switch 71 may be operated from control box 16. It should also be noted that control box 18 is electrically connected to control box 16 for operation of switch 71. Control box 18 may incorporate a switch 82 for communication with the switch 71.

In operation, the trolley 11 may be called by operating one of the control boxes 16 or 18. After the passengers have been loaded onto the trolley 11, the lever 25 is pulled to take up slack in line 32 to pivot bars 61, 62 to pull the cord 70 to operate the switch 71. As the trolley 11 rides on the track 12, vibrations in the line 32 are absorbed and are suppressed at least in part by coil spring 72. Coil spring 66 also participates in absorbing such vibrations and isolating switch 71 from these disturbances so as to minimize the chances of a premature tripping of the switch 71. If the trolley 11 encounters an obstruction on the track 12 or the trolley operation 10 otherwise malfunctions, the operator of the trolley may pull lever 25 to take up slack in the safety line 32 to stop the trolley 11. If the trolley 11 encounters an obstruction on the track 12 when traveling from the lower portion 17 to the upper portion 14 of the track 12, such an obstruction may engage the bumper 49 which then swings toward the frame 40 to swing distal end portion 48 upwardly to take up slack in the safety line 32 to stop the trolley 11. After slack has been taken up in the line 32 and lever 25 has been released, the bars 61, 62 are retracted by the coil spring 66 to return the safety line 32 to its normal, unengaged position to maintain the predetermined amount of tension in the line 32 so that a minimum amount of slack need be taken up in line 32 for operation of switch 71.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In combination with a trolley riding an inclined track, a safety device for stopping the trolley, the combination comprising:

a) an inclined track having upper and lower portions;

b) a trolley riding the track;

c) operating means adjacent to the track for operating the trolley between the upper and lower portions and including a switch; and d) a safety mechanism comprising a safety line extending between the upper and lower portions of the track and connected to the switch of the operating means, and engagement means on the trolley for continuously engaging the safety line and for taking up slack in the line to operate the switch of the operating means to stop the trolley; wherein the safety mechanism includes isolation means connected between the switch and the line for isolating the switch from disturbances in the line during operation of the trolley to minimize premature tripping of the switch.

2. The combination of claim 1, wherein the safety mechanism includes tension means adjacent to the operating means for maintaining a predetermined amount of tension in the safety line to minimize the amount of slack to be taken out of the line to trip the switch, the tension means being biasing to automatically return the line to the predetermined amount of tension after the engagement means has been operated.

3. The combination of claim 2, wherein the tension means further comprises a bar connected to the line and swingably affixed to the operating means, the bar being spring biased to draw the line to the predetermined amount of tension between the upper and lower portions of the track and to automatically return the line to the predetermined amount of tension after the engagement means has been operated.

4. The combination of claim 1, wherein the trolley includes a passenger section and the engagement means comprises a first portion disposed in the passenger section for being operated from the passenger section.

5. The combination of claim 4, wherein the engagement means comprises a lever operable from the passenger section for taking up slack in the safety line.

6. The combination of claim 4, wherein the engagement means further comprises a second portion disposed adjacent to the track to be operated by an obstruction on the track.

7. The combination of claim 6, wherein the engagement means comprises a lever adjacent to the track to take up slack in the safety line.

8. The combination of claim 7, wherein the lever includes a section extending transversely of the track.

9. The combination of claim 1, wherein the isolation means comprises a spring disposed between the line and the switch.

10. The combination of claim 1, wherein the track includes a pair of rails spaced apart by a plurality of crossties.

11. The combination of claim 1, wherein the operating means comprises a cable for towing the trolley up the track and controlling the trolley riding down the track.

12. In combination with a trolley riding an inclined track, a safety device for stopping the trolley, the combination comprising:

a) an inclined track having upper and lower portions, the track including a pair of rails spaced apart by a plurality of crossties, b) a trolley riding the track and having casters engaging the rails, the trolley having a passenger section, c) operating means adjacent to the track for operating the trolley between the upper and lower portions, the operating means including a cable for towing the trolley up the track and controlling the trolley riding down the track, the operating means further including a switch, d) a safety mechanism comprising:

1) a safety line extending between the upper and lower portions of the track and connected to the switch of the operating means;

2) isolation means connected between the switch and the line for isolating the switch from disturbances in the line during operation of the trolley to minimize premature tripping of the switch;

3) tension means adjacent to the operating means for providing the line with a predetermined amount of tension in the line to minimize the amount of slack in the line, the tension means being biased to automatically return the line to the predetermined amount of tension after slack has been taken out of the line; and 4) a lever on the trolley and having a proximal end disposed in the passenger section of the trolley, the lever further having a distal ned for continuously engaging the line and for taking up slack in the line to operate the switch of the operating means to stop the trolley when the proximal end is swung, the lever also including a portion adjacent to the track and extending transversely between the rails, the portion being swung by an obstruction on the track and in turn taking up slack in the line to operate the switch of the operating means to stop the trolley.

* * * * *

UNITED STATES PATENT AND TRADEMARK OFFICE

CERTIFICATE OF CORRECTION

PATENT NO. : 5,142,991

DATED : September 1, 1992

INVENTOR(S) : David L. Theis

It is certified that error appears in the above-identified patent and that said Letters Patent is hereby corrected as shown below:

In column 3, line 12, "3" should be -- 32 --.
In column 4, line 1, "90." should be -- 90° --; in column 4, line 68, claim 2, "biasing" should be -- biased --.
In claim 12, column 6, line 29, "ned" should be -- end --.

Signed and Sealed this

Fourteenth Day of September, 1993

Bruce Lehman

*Attest:*

BRUCE LEHMAN

*Attesting Officer*

*Commissioner of Patents and Trademarks*